United States Patent [19]

Kawakami

[11] 4,455,972

[45] Jun. 26, 1984

[54] CYLINDER BLOCK OF AN INTERNAL COMBUSTION ENGINE

[75] Inventor: Yasushi Kawakami, Yokohama, Japan

[73] Assignee: Nissan Motor Company, Ltd., Yokohama, Japan

[21] Appl. No.: 478,859

[22] Filed: Mar. 25, 1983

[30] Foreign Application Priority Data

Apr. 15, 1982 [JP] Japan ..... 57-53666[U]

[51] Int. Cl.³ ..... F01P 3/02

[52] U.S. Cl. ..... 123/41.74; 123/41.29

[58] Field of Search .... 123/41.01, 41.02, 41.44–41.47, 123/41.72, 41.74, 41.79, 41.28, 41.29, 195 R

[56] References Cited

U.S. PATENT DOCUMENTS 1,985,240 12/1934 Brubaker ..... 123/41.29
4,212,270 7/1980 Nakanishi et al. ..... 123/41.29
4,319,547 3/1982 Bierling ..... 123/41.29

OTHER PUBLICATIONS

*Automotive Engineering Engine Section,* Nissan Motor Co., Ltd., Feb., 1972, pp. 98–100.

*Primary Examiner*—William A. Cuchlinski, Jr.
*Attorney, Agent, or Firm*—Schwartz, Jeffery, Schwaab, Mack, Blumenthal & Koch

[57] ABSTRACT

In a cylinder block having a water jacket, there is disposed a partition wall member which divides the water jacket into upper and lower bore sections. The partition wall member is gradually raised with increase of distance from one axial end of the cylinder block so that the volumes of the upper and lower bores sections reduce and increase, respectively, with increase of distance from the axial one end of the cylinder block. The partition wall member is formed, in the vicinity of the other axial end of the cylinder block, with openings for connecting the upper and lower bore sections. With this arrangement, the cylinder bores in the cylinder block are equally cooled by the cooling water which flows in the upper and lower bore sections, separately.

5 Claims, 3 Drawing Figures

CYLINDER BLOCK OF AN INTERNAL COMBUSTION ENGINE

BACKGROUND OF THE INVENTION

1. Field of the Invention

The present invention relates in general to a cooling system of an internal combustion engine, and more particularly to the construction of a water jacket formed in a cylinder block.

2. Description of the Prior Art

In a water-cooled internal combustion engine, the cylinder block is constructed to have therein a water jacket through which the cooling water from the radiator flows to cool the engine. However, as will become clarified hereinafter, most of cylinder blocks hitherto used are constructed without paying particular attention to the equal cooling to all cylinder bores in the cylinder block. The temperature gap thus appearing in the cylinder block causes a poor operation of the engine especially when the engine is electronically controlled by a temperature signal issued from a sensor mounted to the engine.

SUMMARY OF THE INVENTION

It is therefore an essential object of the present invention to provide an improved cylinder block of which cylinder bores are equally cooled by the cooling water which flows in the water jacket formed therein.

According to the present invention, there is provided a cylinder block of an internal combustion engine, which has axially opposed first and second end portions. The cylinder block comprises first means defining in the cylinder block at last two cylinder bores which are aligned, second means defining in the cylinder block a water jacket which extends axially in the direction from the first end portion to the second end portion while surrounding the cylinder bores, the volume of the water jacket being substantially unchanged throughout the axial length of the water jacket, a partition wall member lying in the water jacket in a manner to divide the water jacket into an upper bore section and a lower bore section, the partition wall member being gradually raised with increase of distance from the first end portion so that the volumes of the upper and lower bore sections reduce and increase, respectively, with increase of distance from the first end portion, the partition wall member being formed, in the vicinity of the second end portion, with openings for connecting the upper and lower bore sections, third means defining in the first end portion a water inlet opening which connects to the upper bore section, fourth means defining in the first end portion another water inlet opening which connects to the lower bore section, and fifth means defining in the second end portion a water outlet opening which connects to the upper bore section.

DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
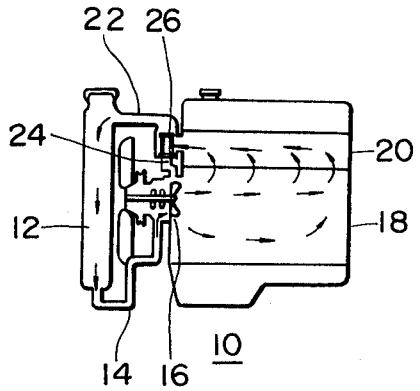
FIG.1 PRIOR ART
FIG. 1 is a sectional view of an internal combustion engine which is equipped with a water-used cooling system.
Figure 2:
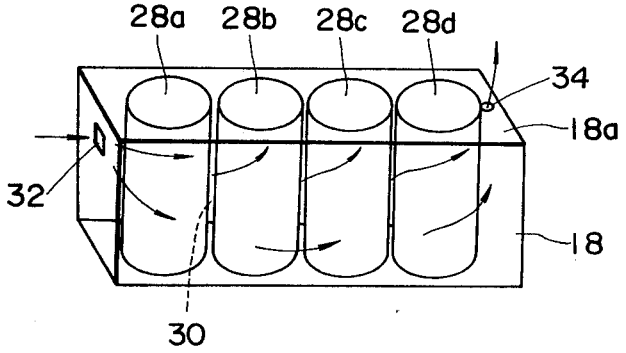
FIG.2 PRIOR ART
FIG. 2 is an illustration of a conventional cylinder block having a water jacket formed therein.

Prior to describing the invention, one of the conventional cylinder blocks of an internal combustion engine will be outlined with reference to FIGS. 1 and 2 in order to clarify the invention.

Referring to FIG. 1, there is shown an internal combustion engine 10 equipped with a water-used cooling system. The cooling system comprises generally a radiator 12, a cooled water feeding conduit 14, a water pump 16, a water jacket in a cylinder block 18, a water jacket in a cylinder head 20, a warmed water feeding or return conduit 22, a bypass passage 24 between the water pump 16 and the return conduit 22, and a thermostat 26 in the return conduit 22. When the thermostat 26 opens because the temperature of the water is higher than a predetermined level, the water circulates in the cooling system in a manner as is indicated by the arrows.

Referring to FIG. 2, there is shown a conventional cylinder block 18 which has a drawback which the present invention can solve. The conventional cylinder block 18 has therein a water jacket 30 which comprises identically shaped spaces each surrounding the corresponding cylinder bore 28*a*, 28*b*, 28*c* or 28*d*. A cooled water inlet opening 32 is formed at an axial end wall (or front end wall) of the cylinder block 18 so that cooled water from the radiator 12 is supplied through the inlet opening 32 into the water jacket 30. An outlet opening 34 is formed in the upper deck 18*a*, at the rear end portion, of the cylinder block 18, so that water after passing through the water jacket 30 is supplied through the outlet opening 34 into the water jacket of the cylinder head 20.

This construction has, however, suffered from a drawback that as the water jacket 30 is uniformly constructed throughout the axial length thereof as is mentioned above, the flow velocity of water in the water jacket 30 is kept substantially constant during its flow therein thereby causing the flowing water to show different cooling effect to the respective cylinder bores 28*a*, 28*b*, 28*c* and 28*d*. In fact, in the above-mentioned construction, the downstream positioned cylinder bore or bores (for example, bores 28*c* and 28*d*) are compelled to be treated or cooled by the water which has been just treated or warmed by the upstream positioned cylinder bore or bores (for example, bores 28*a* and 28*b*). Thus, even or equal cooling effect throughout all of the cylinder bores is not expected in the conventional construction. This phenomenon tends to cause an insufficient operation of the electronically controlled engine which has an engine-mounted engine temperature sensor.

Accordingly, it is an essential object of the present invention to provide a measure which can solve the above-mentioned drawback.

Figure 3:
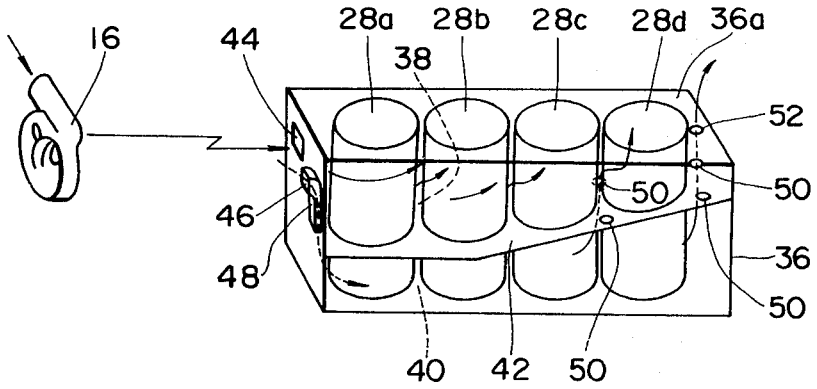
FIG. 3 is an illustration of a cylinder block according to the present invention.

Referring to FIG. 3, there is shown a cylinder block 36 which is constructed to solve the above-mentioned drawback. As is understood from this drawing, the cylinder block 36 is constructed to have therein an upper water jacket 38 and a lower water jacket 40 which are bounded by a partition wall member 42 casted or disposed in the block 36. As is seen, the partition wall member 42 is gradually raised with increase of distance from the front end wall of the cylinder block 36, so that the depth and thus the volume of each water jacket 38 or 40 changes gradually with increase of distance from the front end wall of the block 36. In fact, the volume of the upper water jacket 38 reduces gradually, while the volume of the lower water jacket 40 increases gradually with increase of distance from the front end wall of the block 36. Similar to the afore-mentioned conventional cylinder block 18, a cooled water inlet opening 44 is formed at the front end wall of the block 36, through which the cooled water from the radiator 12 is fed to the upper water jacket 38. In addition to the inlet opening 44, another cooled water inlet opening 46 is formed in the vicinity of the inlet opening 44, and a conduit 48 is formed in the cylinder block 36 to connect the inlet opening 46 with the reduced volume portion of the lower water jacket 40. Thus, the cooled water driven by the water pump 16 is separately introduced through the respective inlet openings 44 and 46 into the upper and lower water jackets 38 and 40. The partition wall member 42 is formed at the rear portion thereof with a plurality of openings 50 which connect the upper and lower water jackets 38 and 40. The upper deck 36*a* of the cylinder block 36 is formed at the rear portion thereof with a water outlet opening 52 which is adapted to connect to a water inlet opening (not shown) of the cylinder head water jacket.

With the construction as described hereinabove, the cooled water from the radiator 12 is separately introduced into the upper and lower water jackets 38 and 40, and flows through the respective jackets 38 and 40 before being discharged therefrom into the water jacket of the cylinder head 20, in a manner as is indicated by the arrows. It is to be noted that, by the nature of the above-mentioned voluminal difference in axial length in each water jacket 38 or 40, the water supplied to the upper water jacket 38 increases its velocity as it flows downstream, while, the water supplied to the lower water jacket 40 decreases its velocity as it flows. This induces that, on the whole, the upstream positioned cylinder bores and the downstream positioned cylinder bores are equally treated or cooled by the cooling water supplied from the radiator 12. In other words, the downstream positioned cylinder bores (for example, bores 28*c* and 28*d*) are treated for relatively short time by the relatively high temperature water which has been highly warmed by the upstream positioned cylinder bores (for example, bores 28*a* and 28*b*) exposed to the upper water jacket 38, and at the same time, the downstream positioned cylinder bores are treated for relatively long time by the relatively low temperature water which has been insufficiently warmed by the upstream positioned cylinder bores exposed to the lower water jacket 40. It is also to be noted that as, as compared with the upper portion of each cylinder bore, the lower portion of each cylinder bore is distant from the corresponding combustion chamber (not shown) which is the heat source, the water passing around the lower portions of the cylinder bores 28*a*, 28*b*, 28*c* and 28*d*, that is, the water flowing in the lower water jacket 40 is less heated as compared with the water flowing in the upper water jacket 38. With these phenomena, all of the cylinder bores formed in the cylinder block 36 of the invention are equally or evenly cooled by the cooling water supplied from the radiator 12.

If desired, the openings 50 of the partition wall member 42 may be so arranged that the number of them increases gradually with increase of distance from the front end portion of the member 42. In this case, much more equable cooling is achieved in the cylinder bores.

What is claimed is:

1. A cylinder block of an internal combustion engine, having axially opposed first and second end wall portions, said cylinder block comprising:

first means defining in said cylinder block at least two cylinder bores which are aligned;

second means defining in said cylinder block a water jacket which extends axially in the direction from said first end wall portion to said second end wall portion while surrounding said cylinder bores, the volume of said water jacket being substantially unchanged throughout the axial length of said water jacket;

a partition wall member lying in said water jacket in a manner to divide said water jacket into an upper bore section and a lower bore section, said partition wall member being gradually raised with increase of distance from said first end wall portion so that the volumes of said upper and lower bore sections reduce and increases, respectively, with increase of distance from said first end wall portion, said partition wall member being formed, in the vicinity of said second end wall portion, with openings for connecting said upper and lower bore sections;

third means defining in said first end wall portion a water inlet opening which connects to said upper bore section;

fourth means defining in said first end wall portion another water inlet opening which connects to said lower bore section; and fifth means defining in said second end wall portion an outlet opening which connects to said upper bore section.

2. A cylinder block as claimed in claim 1, in which the number of the openings formed in said partition wall member increases gradually with increase of distance from the first end wall portion.

3. A cylinder block as claimed in claim 1, in which said another water inlet opening of said fourth means is connected to said lower bore section through a conduit formed in said cylinder block.

4. A cylinder block as claimed in claim 3, in which said another water inlet opening of said fourth means is located in the vicinity of said water inlet opening of said third means.

5. A cylinder block as claimed in claim 4, in which said water outlet opening of said fifth means is formed in the upper deck of said cylinder block.

* * * * *